United States Patent [19]

Arendt

[11] 4,094,172

[45] June 13, 1978

[54] DEVICE FOR ADDING AND/OR REMOVING FLUID MEDIA IN A ROTATING DRUM

[76] Inventor: Hans F. Arendt, Bleichinsel, 712 Bietigheim, Wuertt., Germany

[21] Appl. No.: 701,370

[22] Filed: Jun. 30, 1976

[30] Foreign Application Priority Data

Aug. 30, 1975 Germany ..... 2538694

[51] Int. Cl.[2] ..... D06F 39/08

[52] U.S. Cl. ..... 68/58; 34/242; 68/5 E; 68/207; 277/DIG. 8; 277/21; 277/59

[58] Field of Search ..... 68/58, 207, 5 C, 5 E, 68/139, 148, 157, 171, 208, 20; 141/348, 349, 350; 220/229; 34/242; 69/30; 285/190, 352; 128/214 R; 277/DIG. 8, 21, 59, 130, 131, 132

[56] References Cited

U.S. PATENT DOCUMENTS

| | | | |
|---|---|---|---|
| 1,077,330 | 11/1913 | Clarke | 68/20 |
| 2,309,786 | 2/1943 | Porter | 68/58 X |
| 3,192,649 | 7/1965 | Powell | 34/242 X |
| 3,226,096 | 12/1965 | Ranson | 68/207 X |
| 3,990,445 | 11/1976 | Lundquist | 128/214 R |

*Primary Examiner*—Philip R. Coe
*Attorney, Agent, or Firm*—Bacon & Thomas

[57] ABSTRACT

Disclosed is a device for adding and/or removing fluid media in a rotatable drum, such as a rotating washing machine drum, comprising a pair of flanges attached to the outer periphery of the drum and spaced apart to define an annular space extending around the drum, an elastically yielding sealing member attached to each flange and extending inwardly into the annular space where their sealing lips abut to form a seal in a generally radially extending sealing plane, fluid passageways extending through the wall of the drum in the region between the flanges, and means positioned in the sealing plane for spreading the sealing lips apart, preferably a flat tapered conduit or one or more tapered disks. In another embodiment a sealing device is disclosed having only one flange and one elastically yielding sealing member in association with an annular plate fixed to a partition wall through which the drum extends.

7 Claims, 11 Drawing Figures

DEVICE FOR ADDING AND/OR REMOVING FLUID MEDIA IN A ROTATING DRUM

BACKGROUND OF THE INVENTION

1. Field of the Invention

The present invention relates to a device for adding and/or removing fluid media in a rotating drum, and more particularly to a device adapted for use in connection with a drum-type washing machine, for the addition and/or removal of gaseous or liquid media to the washing drum during rotation.

2. Description of the Prior Art

Heretofore, the addition and/or the removal of the wash, of detergents, of steam, and of other fluids in a drum-type washing machine without housing has been accomplished by means of a so-called rotary head on the drum. Various supply conduits lead from the outside to this rotary head, while secondary conduits lead from the latter to the various points along the drum, where addition or removal of the fluid media is desired. This arrangement constitutes a complex and costly structure, which, because of the arrangement of the conduits in the axis of the drum, represents an undesirable structural hindrance for the movement of the laundry through the drum.

A particular disadvantage of this prior art structure relates to its inflexibility with respect to the adaptation of the laundering process to different process steps. Such an adaptation, if necessary, requires a time-consuming and costly modification of the drum-type washing machine.

SUMMARY OF THE INVENTION

It is a primary objective of the present invention to overcome the above-mentioned prior art shortcomings and limitations by providing a simple device for adding and/or removing fluid media in a rotating drum, especially the drum of a washing machine without housing, the device to be adapted for installation at any point along the axial length of the drum. Furthermore, the novel device is to be constructed so that it can be installed on an existing drum-type washing machine, in a simple modification of the latter.

In accomplishing the foregoing objects there has been provided in accordance with the present invention a novel device for adding and/or removing fluid media in a rotating drum, the device being characterized by an annular gate surrounding the periphery of the drum in the manner of a collar, the annular gate having two elastically yielding tubular sealing collars, each collar having one axial extremity attached to and supported by a flange which is solidary with the drum and its opposite axial extremity curving radially inwardly so as to define a sealing lip against an imaginary radial plane, the two sealing collars facing each other on opposite sides of said radial plane, thereby defining together with the supporting flanges a closed annular space surrounding the outer surface of the drum. In the radial plane itself is arranged a lip-spreading element reaching from the outside into said closed annular space, while the space itself communicates with the inside of the rotating drum through openings in the drum wall.

According to a preferred embodiment of the invention, the tubular sealing collars have a flat-rectangular cross-sectional outline in their free state, the diameter of the collars being preferably smaller than the diameter of their supporting flanges.

The invention further provides that the supporting flanges have a Z-shaped cross-sectional profile, with an outer generally cylindrical flange portion pointing toward the sealing plane and an inner flange portion pointing in the opposite direction and engaging the outer surface of the drum. The sealing collar is appropriately attached to the outer flange portion by means of a suitable clamping ring.

Several different lip-spreading elements may be provided with the device of the invention. They all have in common that they are positioned in the imaginary sealing plane defined by the cooperating sealing lips and that they have a small axial width as compared to their circumferential length, the lip-spreading cross-sectional shape being accordingly elongated and resembling the shape of a lentil or biconvex lens, or of a double-ended projectile. In the case of a conduit, the latter is accordingly flattened on that portion with which it engages the sealing lips. In the case where no conduit is required, as when the sealing lips are merely spread apart for the discharge of fluid from the rotating drum, the lip spreading element may consist of two circumferentially spaced, lentil-shaped rollers with smoothly curved flanks.

Another lip spreading element may be part of a water tank, the latter having a narrow tank portion in alignment with the sealing plane of the annular gate. This narrowed portion preferably reaches around a substantial angular portion of the lower half of the rotating drum so that the tank walls reach higher than the level of the wash inside the drum. The lip-spreading portion of the tank, therefore, has an arcuate cut-out to accommodate the drum, the extremities of the lip-spreading tank portion converging in a wedge-like manner. Such a water tank may additionally be provided with a vertically adjustable overflow conduit.

As an additional embodiment of the invention, there is suggested a mode of heating the wash contained in the rotating drum by using two annular gates with lip-spreading conduit elements, of which one serves as a drum outlet and the other serves as a drum inlet, the outlet and inlet being connected via a bypass conduit with a circulation pump and a suitable heat exchanger.

Lastly, the present invention may also advantageously be adapted to serve as a rotary seal where a drum or other cylindrical body reaches through a stationary partition wall and one side of the wall is to be sealed off from the other. In this case, only one sealing collar and supporting flange assembly is mounted on the rotating drum, the inwardly curving portion of the sealing collar engaging a suitable sliding surface of a preferably flat planar portion of the partition wall.

Further special features and advantages of the invention will become apparent from the description following below, when taken together with the accompanying drawings.

DESCRIPTION OF THE PREFERRED EMBODIMENTS

Figure 1:
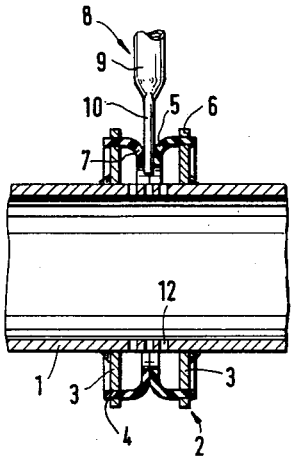
FIG. 1 is a longitudinal cross section through a portion of a rotating drum having arranged thereon an annular gate and a lip-spreading element representing a first embodiment of the device of the invention.
Figure 2:
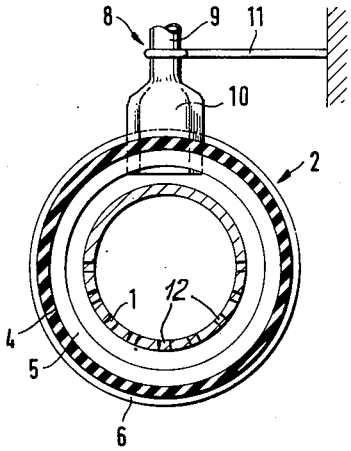
FIG. 2 is a transverse cross section through the device of FIG. 1.
Figure 3:
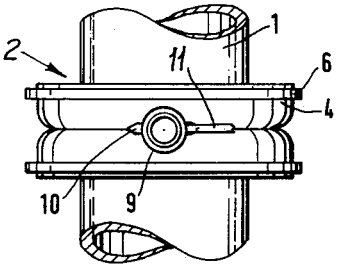
FIG. 3 shows the device of FIG. 1 as seen from above.

Referring to FIGS. 1–3 of the drawing, there is shown a rotating tubular body 1, i.e. a body of hollow cylindrical configuration defined by a wall, the body 1 representing the drum of a drum-type washing machine, for example. Surrounding the drum 1 is an annular gate 2 consisting of two supporting flanges 3 which are attached to the outer surface of the drum at an axial distance from each other. Each supporting flange 3 has attached to its outer diameter 4 an elastically yielding sealing collar 5 which is peripherally clamped to the supporting flange 3 by means of a clamping ring 6. Each sealing collar 5 is in annular relationship with the drum and has a radially inwardly curving sealing lip 7. The two sealing collars 5 are so arranged that their sealing lips 7 engage each other with a certain axial pressure, thereby defining a radially extending sealing plane. The two supporting flanges 3 and the abutting sealing collars 5 thus define a closed annular space surrounding the drum 1 and rotating therewith.

Figure 4:
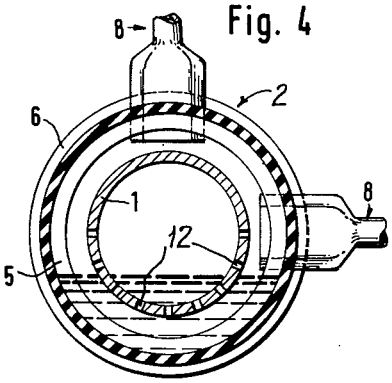
FIG. 4 is similar to FIG. 2, showing a modification of the device of FIGS. 1–3 in that two lip-spreading elements engage the annular gate.
Figure 5:
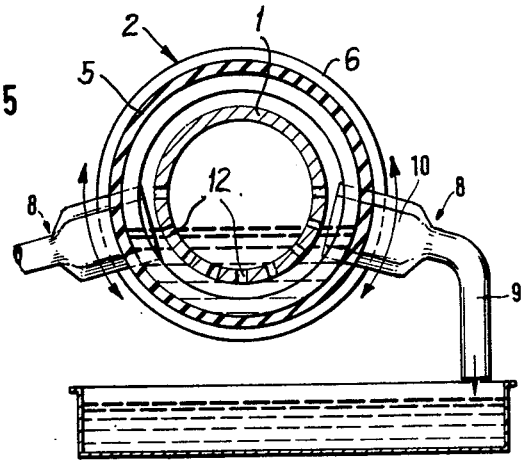
FIG. 5 is similar to FIG. 4, showing the two lip-spreading elements in a different position.

As the drawing indicates, the device of FIGS. 1–3 further includes a lip-spreading element 8 which is engaged between the sealing lips in alignment with the sealing plane defined by the latter. The lip-spreading element 8 is essentially a pipe 9 whose lip-spreading extremity forms a mouthpiece 10 which is flattened in the axial sense, so as to limit the amount by which the sealing lips 7 have to be spread apart, in order to accommodate the mouthpiece 10. Accordingly, the cross-sectional shape of the mouthpiece 10 is preferably axially narrow and circumferentially elongated, with converging leading and trailing extremities. As FIG. 3 indicates, the rotating drum and sealing lips are parted on the leading extremity of the mouthpiece 10, closing again at the trailing extremity thereof. The lip-spreading member 8 itself is held in place by means of a pipe anchor 11 or some other suitable support. While the lip-spreading member 8 thus reaches into the enclosed space inside the annular gate 2, the latter in turn communicates with the interior of the drum 1 through a series of radial bores 12 in the drum wall. These radial bores 12 may be arranged on the full circumference of the drum wall, or they may be limited to an angular portion thereof. As will be apparent from the drawing, FIGS. 4 and 5 show embodiments including a plurality of lip-spreading members 8.

Figure 6:
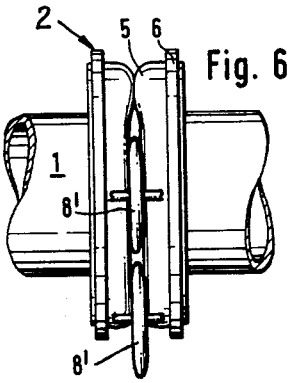
FIG. 6 shows a modified device where an annular gate similar to that of FIGS. 1–3 cooperates with two lip-spreading rollers to form a discharge opening.
Figure 7:
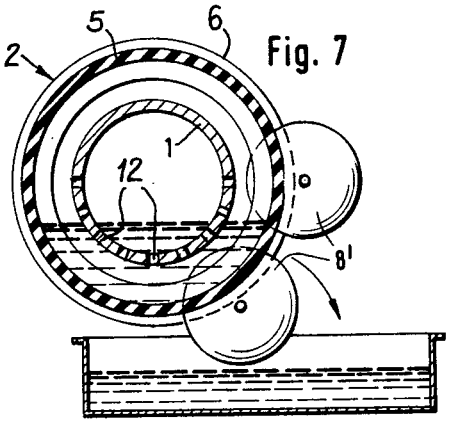
FIG. 7 shows the device of FIG. 6 in a transverse cross section.

A different way of opening the axially abutting sealing lips 7 is shown in FIGS. 6 and 7, where two lip-spreading elements in the form of lentil-shaped rollers 8′ are arranged outside the annular gate 2 at such a distance from the rotating drum 1 that the rollers 8′ penetrate between the sealing lips 7 in their sealing plane. The angular distance between the two rollers 8′ is such that the sealing lips remain open over the circumferential distance which separates the two rollers, thereby creating a convenient discharge opening at this point.

Figure 8:
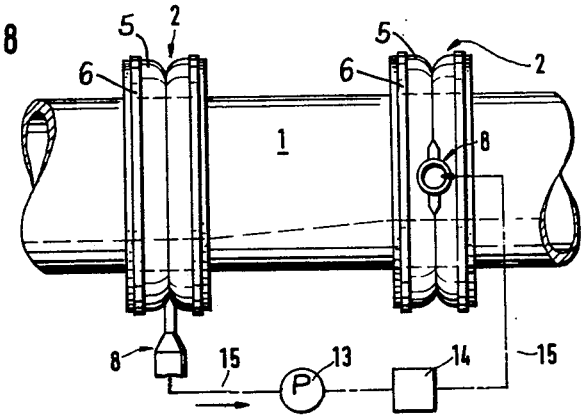
FIG. 8 shows an arrangement of two axially spaced annular gates of the type illustrated in FIGS. 1–3 with a linking bypass conduit and intermediate wash heating means.

In FIG. 8 is illustrated an embodiment of the invention which utilizes two annular gates 2 arranged at axially spaced locations on the rotating drum 1. Each annular gate 2 is engaged by the mouthpiece of a lip-spreading member 8, the one shown on the left in FIG. 8 serving as an outlet, and the one shown on the right serving as an inlet to the drum 1. Between the two members 8 extends a bypass conduit 15 through which the liquid discharging through the left-hand annular gate reaches a circulation pump 13 and a heat exchanger 14, where the liquid is heated prior to re-entering the drum 1 through the right-hand annular gate 2.

Figure 9:
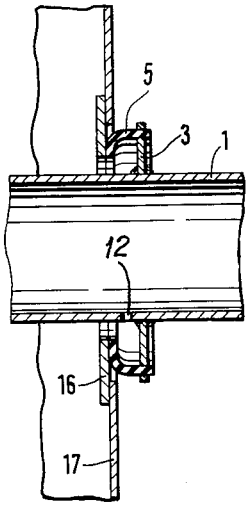
FIG. 9 shows a modified embodiment of the invention employed as a rotary partition wall seal.

In FIG. 9 is shown still another embodiment of the invention, in which a supporting flange 3 and an attached sealing collar 5 cooperate with a flat, centrally apertured plate 16 of a partition wall 17. The plate 16, taking the place of the opposite sealing collar of the previously described annular gate, thus forms a rotary seal for the drum or rotating body 1.

Figure 10:
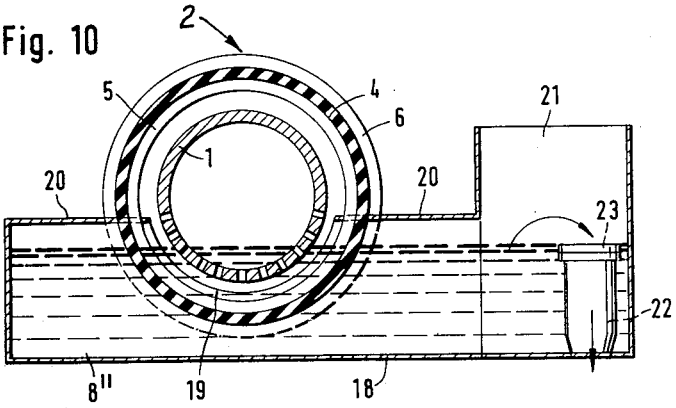
FIG. 10 shows another modified device of the invention, where an annular gate like that of FIGS. 1–3 cooperates with a lip-spreading water tank.
Figure 11:
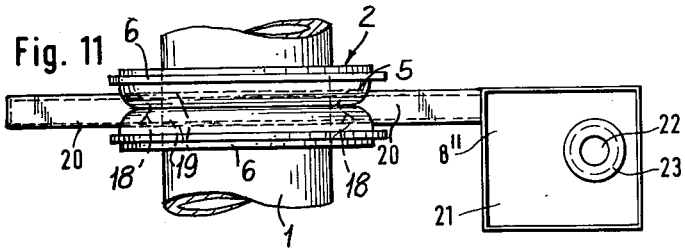
FIG. 11 shows the water tank of FIG. 10 as seen from above.

In FIGS. 10 and 11 is illustrated an embodiment of the invention in which the lip-spreading member 8″ is an integral part of a water tank 21 receiving the liquid from the rotating drum 1 and guiding it through an overflow outlet 22. The lip-spreading member 8″ in this case is a narrow elongated portion 18 of the water tank aligned with the sealing plane of the annular gate 2, the mouthpiece portion of the tank portion 18 cooperating with the sealing collars 5 over a major portion of the lower half of the latter. For this purpose, the contour of the mouthpiece includes an arcuate cutout 19. The mouthpiece portion 18 of the tank is generally similar to the mouthpiece of the member 8 shown in FIGS. 1–3, the leading and trailing, i.e. opening and closing ends of the lip-parting wall portions being suitably tapered. The top wall 20 of the mouthpiece portion 18 of the tank is preferably located above the normal level of the liquid, so that the latter can freely flow into an enlarged tank portion, where an overflow pipe 22 controls the liquid level. This level is adjustable by adding or removing level rings 23 from the upper end of the overflow pipe 22.

The sealing collars 5 of an annular gate as suggested by the present invention may be manufactured in different ways. They are made of an elastic material which is compatible with the liquid contained in the rotating drum and which will cooperate with the mouthpiece of the lip-spreading member 8 without creating excessive wear on the latter. A suitable material for this purpose is rubber. One way of manufacturing the sealing collars 5 is to mold the collars with suitable rubber molding tools, whereby the cross-sectional profile of the sealing collars may incorporate therein the inwardly curving lip portion as a natural state of the collars. However, since a preferred application of the present invention involves its use in conjunction with large drum-type washing machines, where gate diameters in the order of 1.6m may be necessary, the production of the necessary tooling becomes very costly and represents a severe impediment to the adaptation of the invention to different diameters and gate structures. Because of this shortcoming, the present invention further suggests a greatly simplified method of producing and mounting the sealing collars 5. This novel production method involves the following:

It has been found, that a short, large-diameter tubular length portion of elastic material, when stretched on one axial extremity over a supporting flange of larger diameter, maintains substantially the original smaller diameter on its other axial extremity, thereby taking on the desired inwardly curving shape. This means that by stretching one axial extremity of the sealing collar 5 over a larger supporting flange 3, the other axial extremity of the collar assumes an inwardly tapering orientation which means that when two of these sealing collars are mounted so as to axially abut against one another, the inwardly curving cross-sectional shape of FIG. 1 is obtained. For especially large diameters, it is also possible to produce the tubular elastic collars themselves from flat stock, such as rubber panels or rubber belting, for example. A strip of the desired width is first cut from the flat stock, whereupon the strip is formed into a ring by joining is extremities through appropriate bonding or vulcanization. This ring of flat, rectangular cross section is then stretched onto the larger-diameter supporting flange in the manner described further above. The degree to which one extremity of the sealing collar is optimally stretched and the resulting cross-sectional shape of the collar in the mounted position depend upon the gauge of stock utilized, on the physical characteristics such as elasticity, shore hardness, etc. of the stock, and on the axial width of the sealing collar.

Depending upon the degree to which the sealing collars are stretched when mounted on the supporting flanges, their radial gripping action on the latter may be sufficient to hold them in place. Alternatively, suitable clamping rings 6 may be used which engage the stretched extremities of the sealing collars 5, clamping them radially against the periphery of the mounting flanges 3. The sealing collar attachment without clamping rings is more suitable for small diameters than larger ones.

Alternatively, the sealing collars 5 may have grooves for receiving the clamping rings. Such an arrangement has the advantage of permitting the quick removal and replacement of the sealing collars, while positively securing them on the supporting flanges 3 against sliding off.

The supporting flanges 3 may be Z-shaped in cross section, with the outer axial leg of the cross section pointing toward the sealing plane and the inner axial leg of the cross section pointing in the opposite direction. Such a modification of the supporting flange 3 has the advantage of providing large supporting surfaces for the sealing collars 5 on the flange and for the flange on the drum 1. The supporting flanges 3 may be made of one piece, but preferably, they are split into two or three flange segments. Thusly segmented supporting flanges 3, and sealing collars which are made from flat stock, make it possible to assemble an annular gate around an existing drum, under circumstances which would not allow for the gate elements to be inserted axially over the drum.

It is further possible to arrange the supporting flanges 3 in such a way that they are releasably clamped against the drum 1. In conjunction with such a clamping attachment, it is convenient to also provide axial adjustability of the supporting flanges on the drum 1, thereby making it possible to adjust the abutment pressure between the sealing lips 7 of the sealing collars 5, by moving closer or separating the two sealing collars. The invention also makes it possible to axially adjust the position of the sealing plane with respect to the position of the particular lip-spreading element 8. Such adjustability, however, requires that a gasket or some other suitable seal be provided between the mating surfaces of the supporting flange 3 and the drum 1.

Another possibility for axial adjustment of the sealing collars 5 is available, if the sealing collars are made to axially overhang the supporting surface of the supporting flanges 3. This feature makes it possible to axially move the sealing collars relative to the supporting flanges, after the clamping ring 6 has been loosened or removed. The clamping configuration on the outer diameter of the supporting flanges 3 is preferably such that it allows for the sealing collars to be inverted, in case of damage or wear, so that the side which had previously been clamped against the supporting flange now becomes the sealing lip 7.

The annular space which is defined by the two supporting flanges 3 and the associated abutting sealing collars 5 is thus closed against the outside, except where a lip-spreading element parts the two lips for either the insertion or the removal of fluid from the annular gate 2. On the other hand, the interior space of the annular gate 2 is at all times in communication with the inside of the rotating drum, through a number of radial bores 12 in the wall of the drum. It follows that, if a particular liquid level is established inside the rotating drum, the same level is also present in the interior space of the annular gate 2. Accordingly, if a lip-spreading element is positioned in that angular portion of the annular gate 2 which is below its liquid level, a liquid discharge is obtainable, even though the lip-spreading element is not a tube. In this case, the lip-spreading element may therefore be a roller, and preferably two angularly spaced rollers, as shown in FIGS. 6 and 7.

The various types of lip-spreading elements which are shown in the drawings have in common that they are very narrow in the axial sense and accordingly elongated in the circumferential sense, having pointed leading and trailing extremities in the sense of rotation of the drum and annular gate. It is important that this elongated shape of the lip-spreading element, resembling the shape of a lentil or of a double-edged blade, be very smooth and provided with pointed extremities, since the sealing lips 7 of the sealing collars 5 slide along the lip-spreading elements, opening as they meet the leading extremity of the element, and closing again as they move away from it. Obviously, this configuration requires that the stationary lip-spreading element be aligned with the sealing plane which is defined by the two abutting sealing lips 7.

The novel annular gate of the present invention has the advantage of being usable for a number of different purposes and applications: If used in conjunction with a lip-spreading pipe arranged on the uppermost part of the annular gate 2, the pipe can serve to remove vapors from the interior of the drum. In the case of a drum-type washing machine, lip-spreading pipes can be used to introduce wash liquid, rinsing liquid, detergents, and other additives. For this purpose, the inlet pipe is preferably arranged above the liquid level of the drum 1 and annular gate 2. The supply pipe and its mouthpiece 10 are stationary and held in place by means of any suitable support bracket or other support means, suitable supply conduits leading from there to mixing containers, pumps, metering devices, and the like.

The radial bores 12 in the wall of the drum 1 may be arranged on only a portion of the circumference of the drum, thereby creating a fluctuating level of liquid inside the annular gate 2. If, for example, the radial bores 12 are arranged on only one-half of the drum circumference, then there will be no communication between the liquid levels in the drum 1 and in the annular gate 2 so long as the radial bores 12 are located above the liquid level.

When liquid is to be removed from the drum through a pipe, the angular location of the lip-spreading element has to be such that it is covered by the liquid inside the annular gate 2. Depending upon the position of the lower extremity of the inserted mouthpiece 10 of the element 8, the latter may serve as a control element for the maintenance of a particular liquid level inside the drum.

The sealing configuration of the novel annular gate of the invention has the additional advantage of being self-closing inasmuch as any pressure which may exist inside the drum and inside the space of the annular gate tends to increase the abutment pressure between the sealing lips 7 in the sealing plane. On the other hand, this interior pressure would have to rise considerably, before the sealing lips 7 of the collars 5 yield radially to such an extent that they peel outwardly. In general, the axial abutment pressure between the cooperating sealing collars 5 is held fairly low, in order to minimize the friction effect between the sealing lips 7 and the inserted mouthpiece 10 of a lip-spreading element 8. The liquid contained inside the annular gate 2, by its static pressure, also tends to keep the sealing lips 7 in abutment contact. On the other hand, there is no risk whatsoever that the static pressure of the liquid contained inside the drum would ever be enough to peel the sealing lips to the outside, even assuming a drum of a diameter as large as 1.5m.

In the case of sealing collars which are injection-molded or otherwise produced in a shape which is similar to the curved mounted shape of the collars 5, the risk of outward peeling of the sealing lips 7 under internal pressure is somewhat greater. Under such circumstances, it is a simple matter to provide safety rings on the sealing lips which prevent such a deformation of the latter.

In order to minimize the sliding friction between the inserted mouthpiece 10 of a pipe and the moving sealing lips 7, it is also possible to arrange in the sealing plane an opening roller 8' ahead of the mouthpiece 10. An additional lip-spreading roller may be arranged behind the mouthpiece. As mentioned earlier, the discharge mouthpiece can be left off entirely for discharge purposes (FIG. 7).

Where a large amount of liquid has to be removed rapidly from the drum, the preferred lip-spreading element is one that extends over a large angle of the annular gate 2. Such is the case with the water tank of FIG. 10, where the sealing lips 7 are held open over almost one-half of their circumference, so that a large amount of liquid can flow from the interior of the annular gate 2 into the tank 21.

A combination of two axially spaced annular gates 2 with appropriate inlet and outlet pipes and mouthpieces can conveniently serve as gates for a liquid bypass conduit for heating or cooling purposes, for example. This application is illustrated in FIG. 8. While the discharge element 8 is located at the bottom of the gate 2, for gravity flow of the liquid into the pipe 15, the re-entry element 8 is located above the liquid level. Between the two annular gates is arranged a piping system with a circulation pump 13 and a heater 14. Such a stationary arrangement is very advantageous for washing installations, making it possible to use as a heat supplying medium either steam, or hot water, or oil. It is also suitable for the installation of a gas or oil burner.

Lastly, this type of bypass line also lends itself conveniently for adjustability of the rate of heat input to the drum, by increasing the rate at which liquid is withdrawn and returned to the drum, through adjustment of the pumping speed, or by changing the heat transfer rate in the heater 14.

The heating of drum-type washing machines has heretofore been one of the major problems in washing machine technology. In the prior art solution which uses heating pockets, the steam coils could only be used at approximately one-quarter of their capacity, because they would be in contact with the wash only for a short time while the drum rotates. This heating system also requires complex connections in the drum head for the supply of steam and the return of condensate, a costly and troublesome aspect of this type of machine. In another prior art version of a drum-type washing machine, there is provided a heating trough underneath the rotating drum. This approach is subject to problems in connection with the sealing of the drum which rotates in the heating trough.

The dual-gate application of the invention with bypass conduit can also be advantageously utilized for purposes other than heating of the wash, as when it is desired to verify and/or adjust the concentration and composition of the wash. In such a case, the liquid which enters the bypass conduit is analyzed in the upstream portion of that conduit and provisions are made for the metered addition of particular substances in the downstream portion of the bypass conduit.

Still another advantageous use of the constituent elements of the annular gate of the invention in connection with special washing machines for hospital applications. There, it is a requirement that, while the inlet side and the outlet side of the drum are open, the areas surrounding the two ends of the drum be separated and sealed off by a partition wall which keeps a room in which the outlet side is located safe against germs. Such an application is illustrated in FIG. 9. As can be seen there, the rotating drum 1 reaches through an aperture in the partition wall 9, the latter carrying a flat annular plate 16 against which a single sealing collar 5, carried by a supporting flange 3, abuts as it rotates with the drum 1. The annular plate 16 is preferably a stainless steel plate. Of course, it is also possible to reverse the cooperating parts of this wall seal by attaching the sealing collar to the stationary plate 16, so that the sealing collar is part of the stationary wall, a planar plate attached to and rotating with the drum 1 contacting the sealing lip of the stationary sealing collar.

It should be understood, of course, that the foregoing disclosure describes only preferred embodiments of the invention and that it is intended to cover all changes and modifications of these examples of the invention which fall within the scope of the appended claims.

I claim:

1. A device for adding and/or removing fluid media in a rotatable drum, comprising:

(a) a rotatable drum of hollow cylindrical configuration defined by a wall;

(b) a pair of annular flange members attached to the outer periphery of the drum and spaced apart to define an annular space extending around the drum;

(c) an elastically yielding sealing member attached to each of said flange members in annular relationship with said drum, each sealing member extending inwardly into said annular space and terminating in a sealing lip, with the respective sealing lips abutting against one another to form a seal in a generally radially extending plane;

(d) at least one fluid media passageway extending through the wall of the drum in the region between the flange members; and (e) means positioned in said sealing plane for spreading said sealing lips apart, said lip-spreading means comprising a conduit having a generally flattened mouthpiece with a cross-sectional shape having its leading and trailing edges converging to a taper, said lip-spreading means extending into said annular space from the exterior to effect communication with the annular space, said fluid media passageway effecting communication between the annular space and the interior of the cylindrical drum.

2. The device in accordance with claim 1, further comprising a clamping ring attaching each sealing member to a respective flange member.

3. The device in accordance with claim 1, wherein said mouthpiece has a biconvex cross-sectional shape.

4. The device in accordance with claim 1, wherein said mouthpiece has a double-edge blade-like cross-sectional shape.

5. The device in accordance with claim 1, comprising a plurality of said lip-spreading means.

6. A device in accordance with claim 1, comprising a first lip-spreading means serving as an outlet from the drum, a second lip-spreading means serving as a return inlet to the drum, and a bypass conduit, including a circulation pump and a heat exchanger, interconnecting said first and second lip-spreading means.

7. The device in accordance with claim 1 including a plurality of fluid media passageways extending through the wall of the drum in the region between the flange members, said fluid media passageways taking the form of radial bores through the wall of the drum.

* * * * *